US008745962B2

(12) United States Patent
Squarzoni et al.

(10) Patent No.: US 8,745,962 B2
(45) Date of Patent: Jun. 10, 2014

(54) CIGARETTE PACKING MACHINE FOR PRODUCING A RIGID, HINGED-LID PACKET

(75) Inventors: Michele Squarzoni, Ferrara (IT); Fabrizio Ronzani, Bologna (IT); Marco Ghini, Monte San Pietro (IT); Stefano Negrini, Calderara di Reno (IT)

(73) Assignee: G.D Societa' per Azioni, Bologna (IT)

( * ) Notice: Subject to any disclaimer, the term of this patent is extended or adjusted under 35 U.S.C. 154(b) by 747 days.

(21) Appl. No.: 12/867,034

(22) PCT Filed: Feb. 11, 2009

(86) PCT No.: PCT/EP2009/051599

§ 371 (c)(1),
(2), (4) Date: Nov. 10, 2010

(87) PCT Pub. No.: WO2009/101120

PCT Pub. Date: Aug. 20, 2009

(65) Prior Publication Data

US 2011/0041463 A1 Feb. 24, 2011

(30) Foreign Application Priority Data

Feb. 13, 2008 (IT) ..... BO2008A0092

(51) Int. Cl.
*B65B 11/58* (2006.01)
*B65B 41/18* (2006.01)

(52) U.S. Cl.
USPC ..... 53/449; 53/170

(58) Field of Classification Search
USPC ..... 53/449, 170
See application file for complete search history.

(56) References Cited

U.S. PATENT DOCUMENTS 4,267,926 A 5/1981 Toimil

FOREIGN PATENT DOCUMENTS

WO WO 2005/087595 9/2005

OTHER PUBLICATIONS

International Search Report and Written Opinion for corresponding International Application No. PCT/EP2009/051599, dated Jun. 15, 2009 (9 pp.).

*Primary Examiner* — Thanh Truong
*Assistant Examiner* — John Paradiso
(74) *Attorney, Agent, or Firm* — Marshall, Gerstein & Borun LLP

(57) ABSTRACT

A cigarette packing machine for producing a rigid packet a hinged lid has a first packing unit which folds a first blank about a group of cigarettes to form an outer container with a hinged lid; and a second packing unit which folds a second blank about the outer container to form a tubular slide surrounding the outer container to slide axially with respect to the outer container; the tubular slide has a transmission member, in turn having a first end integral with the lid, a second end opposite the first end and integral with the slide, and a deformable intermediate portion having a U-shaped fold between the outer container and the slide.

22 Claims, 11 Drawing Sheets

CIGARETTE PACKING MACHINE FOR PRODUCING A RIGID, HINGED-LID PACKET

CROSS-REFERENCE TO RELATED APPLICATIONS

This is the U.S. national phase of International Application No. PCT/EP2009/051599, filed Feb. 11, 2009, which claims the benefit of Italian Patent Application No. BO2008A000092, filed Feb. 13, 2008.

TECHNICAL FIELD

The present invention relates to a cigarette packing machine for producing a rigid, hinged-lid packet.

BACKGROUND ART

Rigid, hinged-lid packets of cigarettes are currently the most widely marketed, by being easy to produce, practical and easy to use, and by effectively protecting the cigarettes inside.

A rigid, hinged-lid packet of cigarettes comprises an inner package comprising a group of cigarettes wrapped in a sheet of foil; and a rigid outer package housing the inner package. The outer package is formed by folding a rigid blank about the inner package, and comprises a cup-shaped container having an open top end; and a cup-shaped lid hinged to the container along a hinge to rotate, with respect to the container, between an open and a closed position opening and closing the open end respectively.

A new type of rigid, hinged-lid packet of cigarettes has recently been proposed comprising a tubular slide which surrounds and slides axially with respect to the outer package. The tubular slide is formed by folding a further rigid blank about the outer package, and comprises a transmission member having a first end integral with the lid, a second end integral with the slide, and a deformable intermediate portion with a U-shaped fold between the outer package and the slide.

Manufacturing this new type of packet calls for feeding and folding two separate rigid blanks successively about the inner package, and so involves major complications to adapt a standard packing machine. In this connection, it is important to bear in mind the numerous structural and dimensional constraints in an existing packing machine, and the necessity to allow adequate access to all the component parts of the machine for cleaning and maintenance purposes.

US4267926A1 discloses a box having inner and outer components made from individual cut blanks; the inner component includes an integral tongue member arranged to form a loop which functions to actuate a folding lid. For production, the two blanks are first punched out and the tongue is punched out at the same time and a flexible area of the tongue is achieved by scoring or indenting; next the inner box with the flexible area is folded and filed and then the outer box is folded around the closed, filler inner box, after the area of adhesion has first been covered with glue.

DISCLOSURE OF THE INVENTION

It is an object of the present invention to provide a cigarette packing machine for producing a rigid hinged-lid packet, which packing machine is suitable for producing the packet of cigarettes described above, while at the same time being easy and relatively cheap to implement.

According to the present invention, there is provided a cigarette packing machine for producing a rigid, hinged-lid packet, as claimed in the accompanying Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 2:
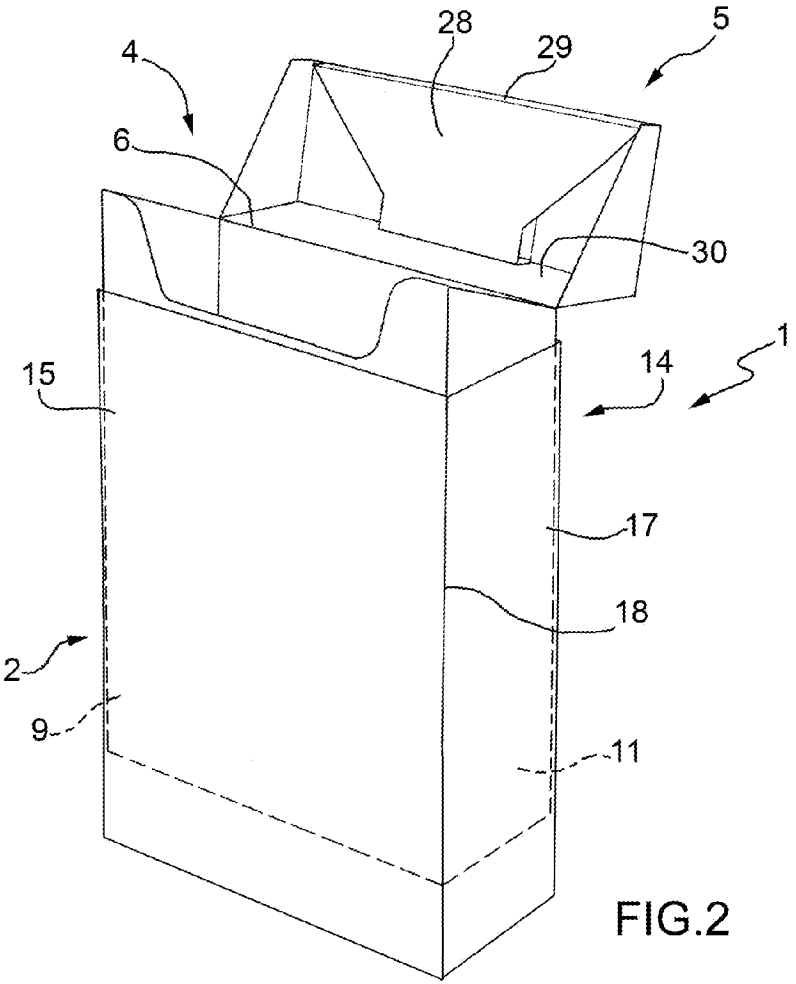
FIG. 2 shows a front view in perspective of the FIG. 1 packet of cigarettes in an open configuration.

Number 1 in FIGS. 1-4 indicates as a whole a rigid packet of cigarettes, which comprises a cup-shaped outer container 2 made of rigid cardboard; and an inner package 3 (shown schematically in FIGS. 3 and 4) housed inside outer container 2 and containing a parallelepiped-shaped group of cigarettes.

Outer container 2 has an open top end 4; and a cup-shaped lid 5 hinged to container 2 along a hinge 6 to rotate, with respect to container 2, between an open position (FIGS. 2 and 4) and a closed position (FIGS. 1 and 3) opening and closing open top end 4 respectively.

When lid 5 is closed, outer container 2 is in the form of a rectangular parallelepiped comprising a top wall 7 and a parallel, opposite bottom wall 8; two parallel, opposite major lateral walls 9 and 10; and two parallel, opposite minor lateral walls 11. More specifically, one major lateral wall 9 defines a front wall 9 of outer container 2, and the other major lateral wall 10 defines a rear wall 10 of outer container 2. Four longitudinal edges 12 are defined between lateral walls 11 and front and rear walls 9, 10; and eight transverse edges 13 are defined between top and bottom walls 7, 8 and front, rear and lateral walls 9, 10, 11.

It is important to note that lid 5 has substantially no front wall, i.e. the whole of front wall 9 forms part of outer container 2.

The top portions of minor lateral walls 11 of outer container 2 act as a collar by engaging a corresponding inner surface of the closed lid 5, and so aid in holding lid 5 in the closed position.

Packet 1 of cigarettes also comprises a tubular slide 14, which surrounds outer container 2 snugly (but with some clearance) to slide axially with respect to outer container 2. Slide 14 is the same parallelepiped shape and size as outer container 2, and comprises two parallel, opposite major lateral walls 15 and 16, and two parallel, opposite minor lateral walls 17. More specifically, one major lateral wall 15 defines a front wall 15 of slide 14, and the other major lateral wall 16 defines a rear wall 16 of slide 14. And four longitudinal edges 18 are defined between lateral walls 17 and front and rear walls 15, 16.

In the embodiment shown in the drawings, slide 14 is substantially the same size longitudinally (in height) as outer container 2. In an alternative embodiment not shown, slide 14 is smaller longitudinally than outer container 2, and is roughly half the longitudinal size of outer container 2.

Packet 1 of cigarettes also comprises a transmission member 19 having an end 20 integral with slide 14, and an end 21 integral with lid 5 and opposite end 20. Transmission member 19 also comprises a deformable intermediate portion 22 having a U-shaped fold between outer container 2 and slide 14. More specifically, end 21 of transmission member 19 is glued to an outer surface of rear wall 10 of lid 5, and end 20 of transmission member 19 is preferably glued to an inner surface of rear wall 16 of slide 14.

Slide 14 slides axially, with respect to outer container 2 and away from open top end 4, from a top position (FIGS. 1, 3) in which lid 5 closes open top end 4, to a bottom position (FIGS. 2, 4) in which lid 5 opens open top end 4.

When slide 14 is slid axially down with respect to outer container 2 from the top position (FIGS. 1, 3) to the bottom position (FIGS. 2, 4), transmission member 19 connecting rear wall 10 of lid 5 to rear wall 16 of slide 14 opens lid 5 by forcing lid 5 to rotate about hinge 6 and with respect to outer container 2. In other words, as rear wall 16 of slide 14 slides down, to begin with transmission member 19 is deformed and exerts no appreciable force on lid 5; but, as rear wall 16 of slide 14 slides further down, transmission member 19 is drawn taut, by not being able to deform further, and so pulls down rear wall 10 of lid 5 to rotate lid 5 about hinge 6 and with respect to outer container 2.

Conversely, when slide 14 is slid axially up with respect to outer container 2 from the bottom position (FIGS. 2, 4) to the top position (FIGS. 1, 3), rear wall 16 of slide 14 acts on rear wall 10 of lid 5 to close lid 5 by forcing lid 5 to rotate about hinge 6 and with respect to outer container 2. In other words, as rear wall 16 of slide 14 slides up, it eventually collides with rear wall 10 of lid 5, thus rotating lid 5 about hinge 6 and with respect to outer container 2.

Lid 5 is therefore opened and closed by simply sliding slide 14 down or up with respect to outer container 2, and without ever touching lid 5 (which, among other things, is completely concealed by slide 14 in the closed position).

Figure 5:
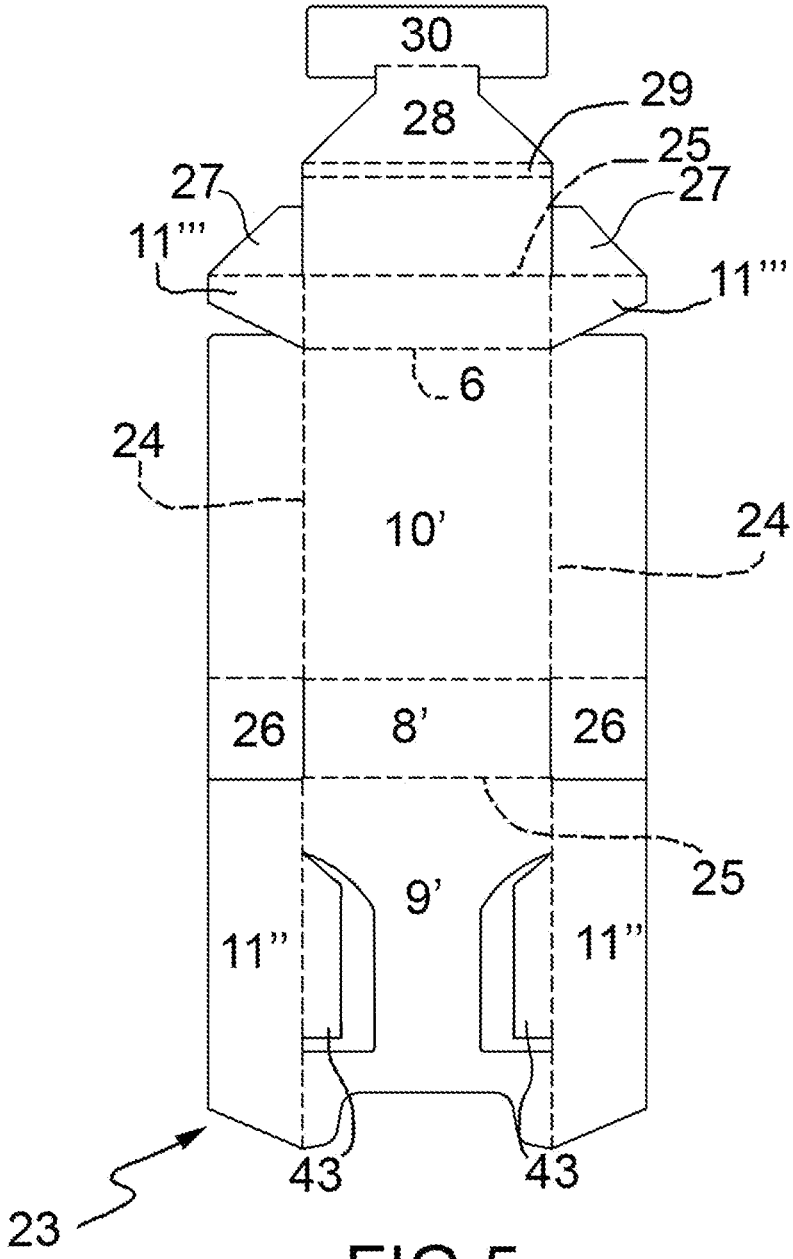
FIG. 5 shows a spread-out view of a blank from which to form an outer container of the FIG. 1 packet of cigarettes.

As shown in FIG. 5, outer container 2 is formed by folding a flat, substantially elongated rectangular blank 23 of rigid cardboard. In the following description, the parts of blank 23 are indicated, where possible, using the same reference numbers, with superscripts, as for the corresponding parts of outer container 2.

Blank 23 has two longitudinal fold lines 24, and a number of transverse fold lines 25 defining, between the two longitudinal fold lines 24, a panel 7' forming top wall 7; a panel 10' forming rear wall 10; a panel 8' forming bottom wall 8; and a panel 9' forming front wall 9.

Panel 9' has two tabs 11' located on opposite sides of panel 9', separated from panel 9' by the two longitudinal fold lines 24, and forming respective outer portions of lateral walls 11 of outer container 2. Panel 10' has two tabs 11" located on opposite sides of panel 10', separated from panel 10' by the two longitudinal fold lines 24, and forming respective inner portions of lateral walls 11 of outer container 2. Panel 10' also has two tabs 11'" located on opposite sides of panel 10', separated from panel 10' by the two longitudinal fold lines 24, and forming lateral walls 11 of lid 5.

Tabs 11" of panel 10' have respective flaps 26, which are folded squarely and glued to the inside of panel 8' forming bottom wall 8.

Tabs 11'" of panel 10' have respective flaps 27, which are folded squarely and glued to the inside of panel 7' forming top wall 7.

Panel 7' forming top wall 7 has a reinforcing flap 28, which is folded 180° onto the inner surface of panel 7' (i.e. onto the inner surface of top wall 7). In the FIG. 1-6 embodiment, flap 28 is maintained a given distance from the inner surface of top wall 7, and has a connecting strip 29 which is folded squarely with respect to flap 28 and connects flap 28 to top wall 7; and a connecting strip 30 which is folded squarely with respect to flap 28, connects flap 28 to rear wall 10, and is glued to rear wall 10.

Figure 6:
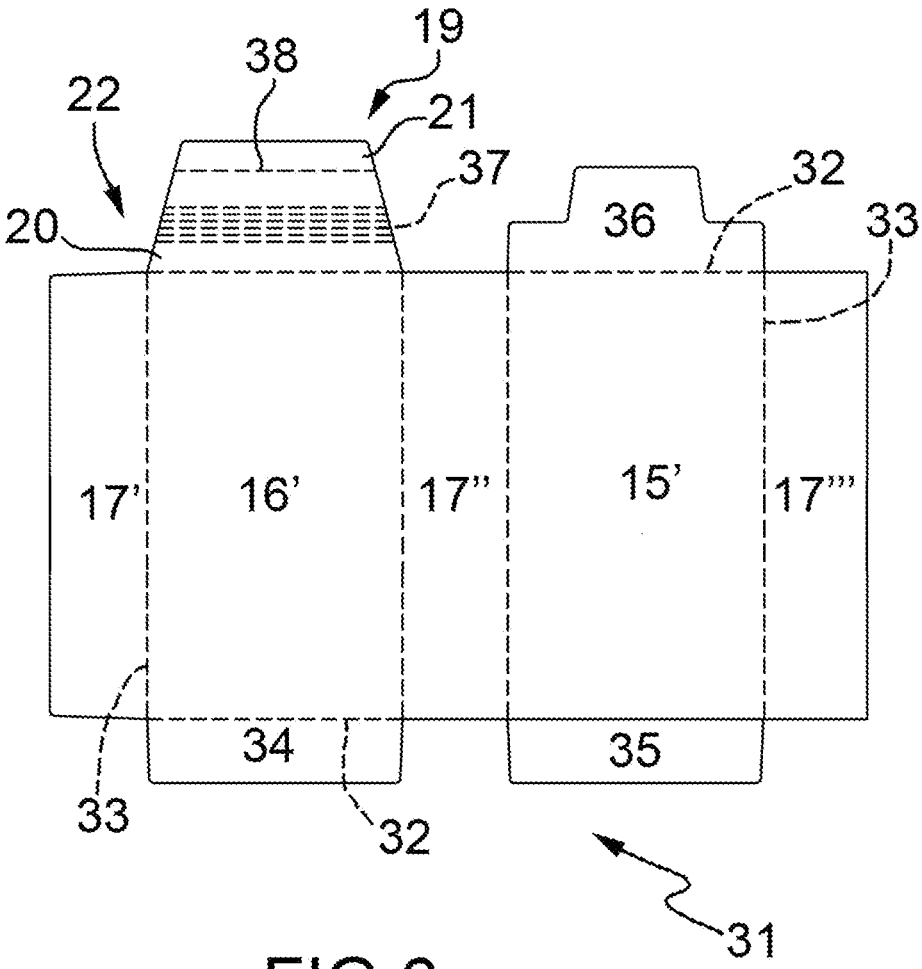
FIG. 6 shows a spread-out view of a blank from which to form a slide of the FIG. 1 packet of cigarettes.

As shown in FIG. 6, slide 14 is formed by folding a flat, substantially elongated rectangular blank 31 of rigid cardboard. In the following description, the parts of blank 31 are indicated, where possible, using the same reference numbers, with superscripts, as for the corresponding parts of slide 14.

Rigid blank 31 has two transverse fold lines 32, and a number of longitudinal fold lines 33 defining, between the two transverse fold lines 32, a panel 17' forming a portion of a first lateral wall 17; a panel 16' forming rear wall 16; a panel 17" forming a second lateral wall 17; a panel 15' forming front wall 15; and a panel 17'" forming another portion of first lateral wall 17.

Panel 16' supports transmission member 19 which is separated from panel 16' by a transverse fold line 32, and is folded 180° onto panel 16'. Panel 16' also has a tab 34 which is located at the opposite end to transmission member 19, is separated from panel 16' by a transverse fold line 32, and is folded 180° onto panel 16'. Panel 15' has two tabs 35 and 36, which are located at opposite ends of panel 15', are separated from panel 15' by two transverse fold lines 32, and are folded 180° onto panel 15'.

In a different embodiment not shown, tab 35 may be replaced with two tabs connected to panel 15' of blank 31 (i.e. to front wall 15 of slide 14) along two respective oblique fold lines that meet in the centre of panel 15', forming an inverted "V".

In a preferred embodiment shown in FIG. 6, intermediate portion 22 of transmission member 19 is made (more) deformable by a number of closely spaced transverse crease lines 37, which greatly increase the flexibility of the U-folded intermediate portion 22 of transmission member 19.

The end 21 of transmission member 19 integral with lid 5 is separated from intermediate portion 22 of transmission member 19 by a transverse fold line 38.

Figure 7:
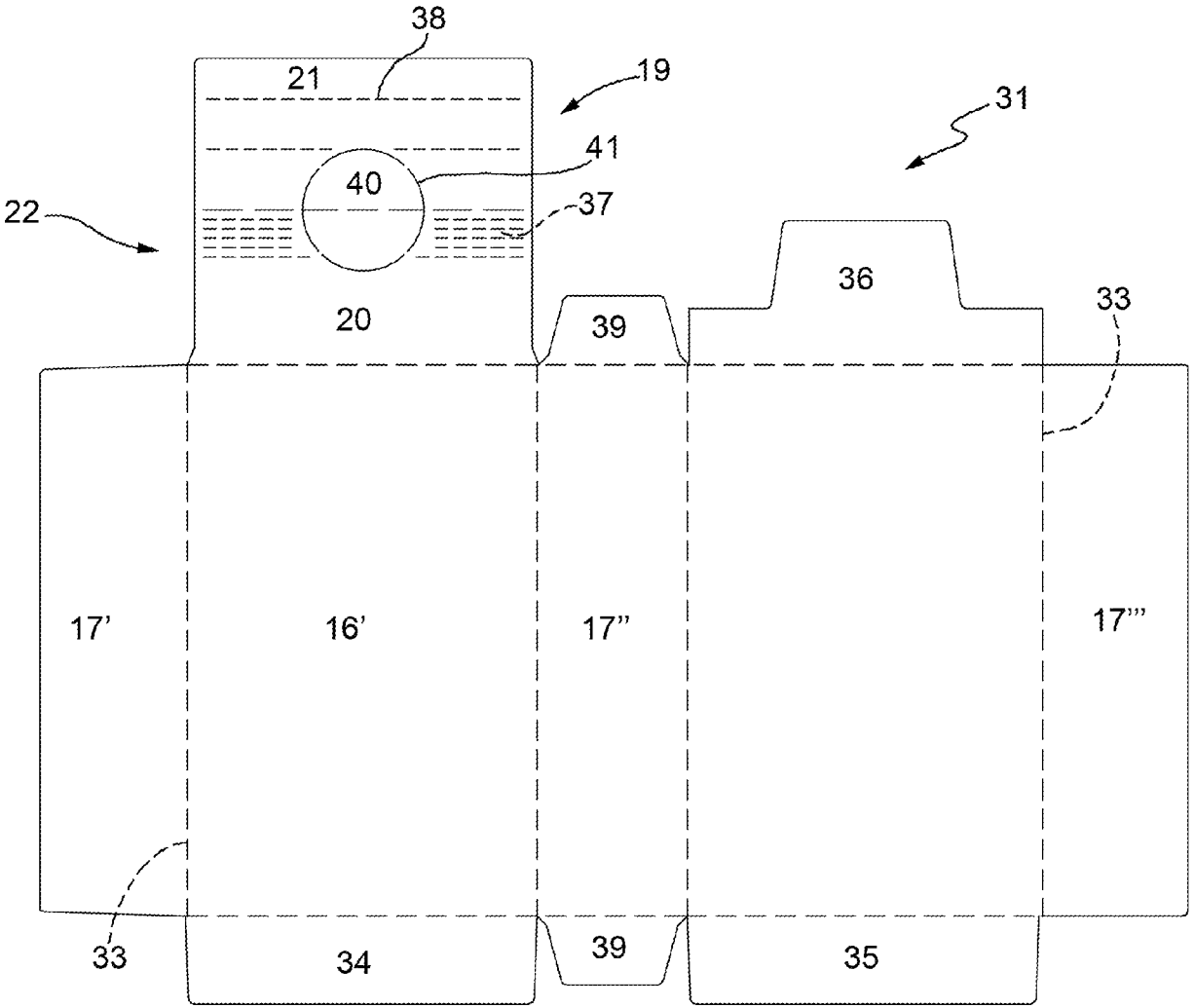
FIG. 7 shows a variation of the FIG. 6 blank.

The FIG. 7 blank 31 differs from the FIG. 6 blank 31 by comprising a further two tabs 39 located at opposite ends of panel 17" and separated from panel 17" by the two transverse fold lines 32. The FIG. 7 blank 31 also differs from the FIG. 6 blank 31 by transmission member 19 having a central (preferably circular) fastening portion 40, which is glued to the rear wall 16 of slide 14 (i.e. to panel 16' of blank 31), and is separated from the rest of transmission member 19 by an endless tear line 41, which is torn when unsealing lid 5.

The central fastening portion 40 serves to keep transmission member 19 folded down onto panel 16' of blank 31. In other words, to form packet 1 of cigarettes, transmission member 19 is preferably folded onto panel 16' of blank 31 beforehand (i.e. upstream from the packing machine). But, without the aid of central fastening portion 40 glued to panel 16', transmission member 19 would not stay folded down onto panel 16' of blank 31 when handling (storing, carrying, feeding, folding) blank 31.

Tests show that, when unsealing lid 5, tearing along endless tear line 41 is barely noticeable by the user and therefore in no way a source of annoyance. On the contrary, a little extra effort to unseal lid 5 is often reassuring to users, by proving packet 1 of cigarettes has not been tampered with, i.e. already opened.

Figure 1:
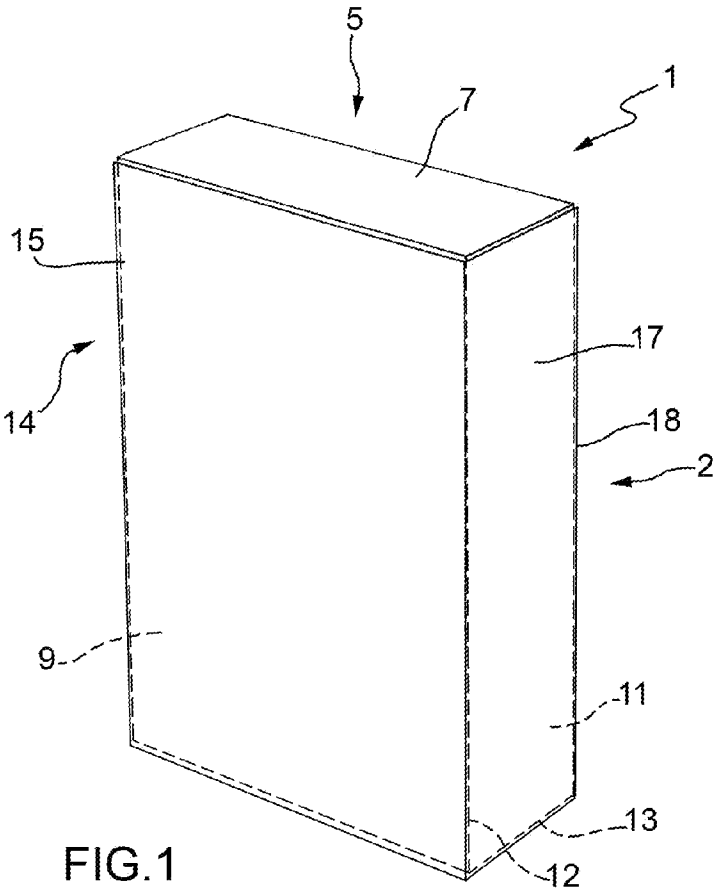
FIG. 1 shows a front view in perspective of a packet of cigarettes in a closed configuration.
Figure 3:
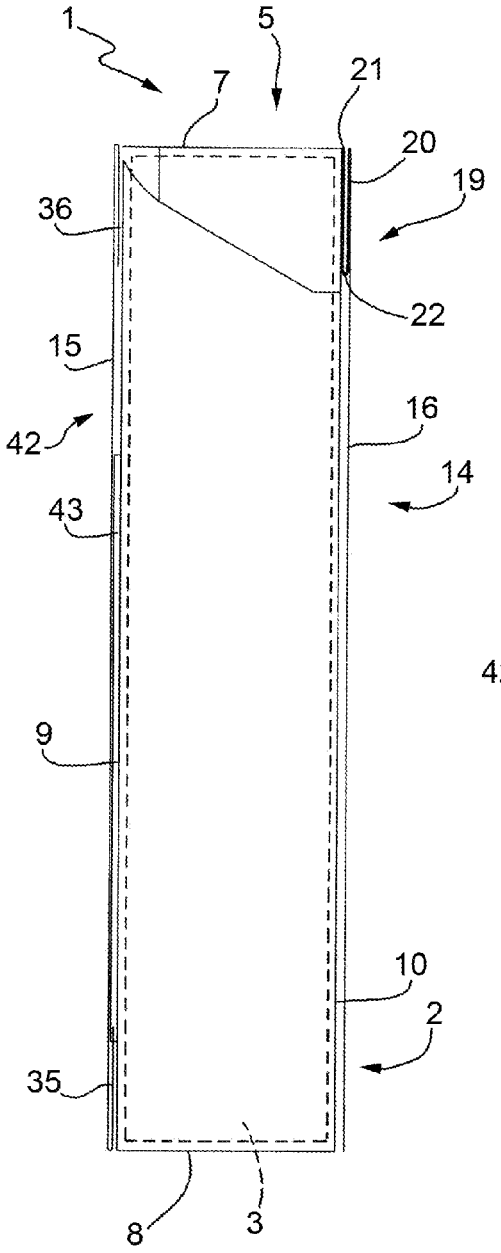
FIG. 3 shows a longitudinally sectioned side view of the FIG. 1 packet of cigarettes in a closed configuration.

In a preferred embodiment, and with reference to FIGS. 3-6, packet 1 of cigarettes comprises a stop device 42 for limiting slide of slide 14 with respect to outer container 2, and defining both the bottom position (FIGS. 2, 4) and top position (FIGS. 1, 3).

Stop device 42 comprises two tabs 43 integral with outer container 2; and tabs 35 and 36 integral with slide 14. Each tab 43 is preferably defined in a through hole formed through front wall 9 of outer container 2 (i.e. through panel 9' of blank 23). Tabs 35 and 36 are integral with slide 14, are folded inwards of slide 14 so they are positioned between slide 14 and outer container 2, and interfere mechanically with tabs 43, integral with outer container 2, when slide 14 is slid with respect to outer container 2. Tabs 35 and 36 are connected to a bottom edge and a top edge respectively of front wall 15 of slide 14 (i.e. of panel 15' of blank 31) along respective transverse fold lines 32.

Figure 4:
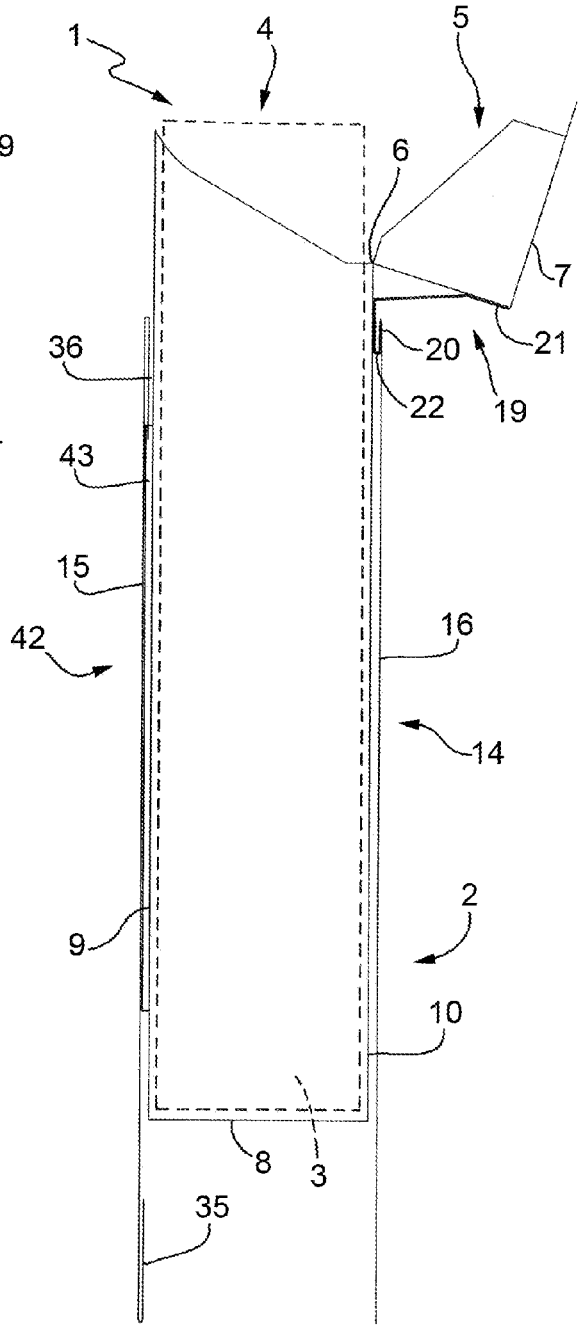
FIG. 4 shows a longitudinally sectioned side view of the FIG. 1 packet of cigarettes in an open configuration.

When slide 14 is slid axially downwards with respect to outer container 2 from the top position (FIGS. 1, 3) to the bottom position (FIGS. 2, 4), the two tabs 43 integral with outer container 2 slip beneath tab 36 integral with slide 14, until tabs 43 eventually hit the transverse fold of tab 36, thus stopping downward slide of slide 14 and defining the bottom position (FIGS. 2, 4). In other words, mechanical interference between tabs 43, integral with outer container 2, and tab 36, integral with slide 14, defines a bottom stop to arrest axial slide of slide 14 with respect to outer container 2.

Conversely, when slide 14 is slid axially upwards with respect to outer container 2 from the bottom position (FIGS. 2, 4) to the top position (FIGS. 1, 3), the two tabs 43 integral with outer container 2 slip beneath tab 35 integral with slide 14, until tabs 43 eventually hit the transverse fold of tab 35, thus stopping upward slide of slide 14 and defining the top position (FIGS. 1, 3). In other words, mechanical interference between tabs 43, integral with outer container 2, and tab 35, integral with slide 14, defines a top stop to arrest axial slide of slide 14 with respect to outer container 2.

Figure 8:
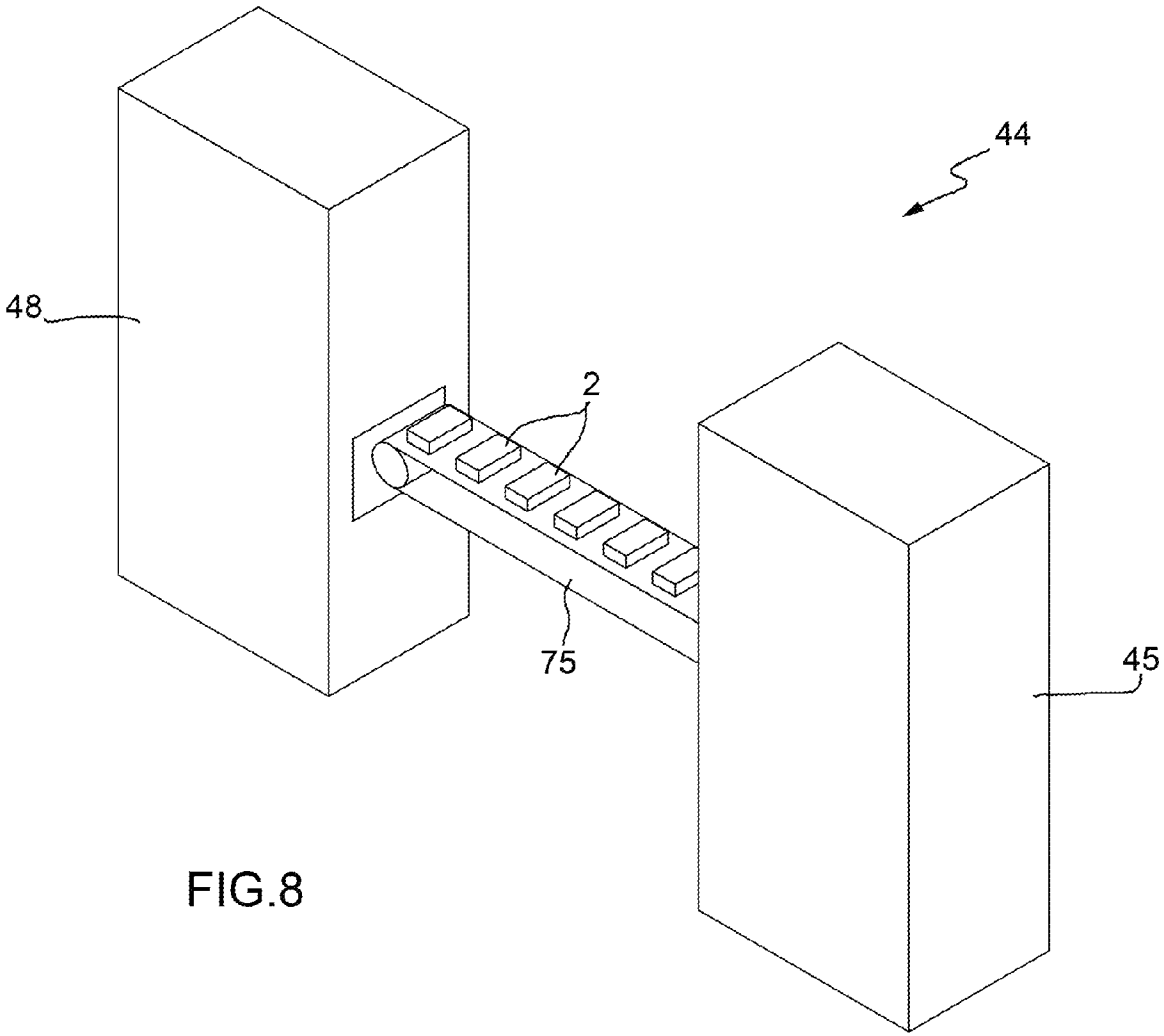
FIG. 8 shows, schematically, a cigarette packing machine in accordance with the present invention and for producing the FIG. 1 packet of cigarettes.

Number 44 in FIG. 8 indicates as a whole a packing machine for producing packets 1 of cigarettes of the type described above.

Figure 9:
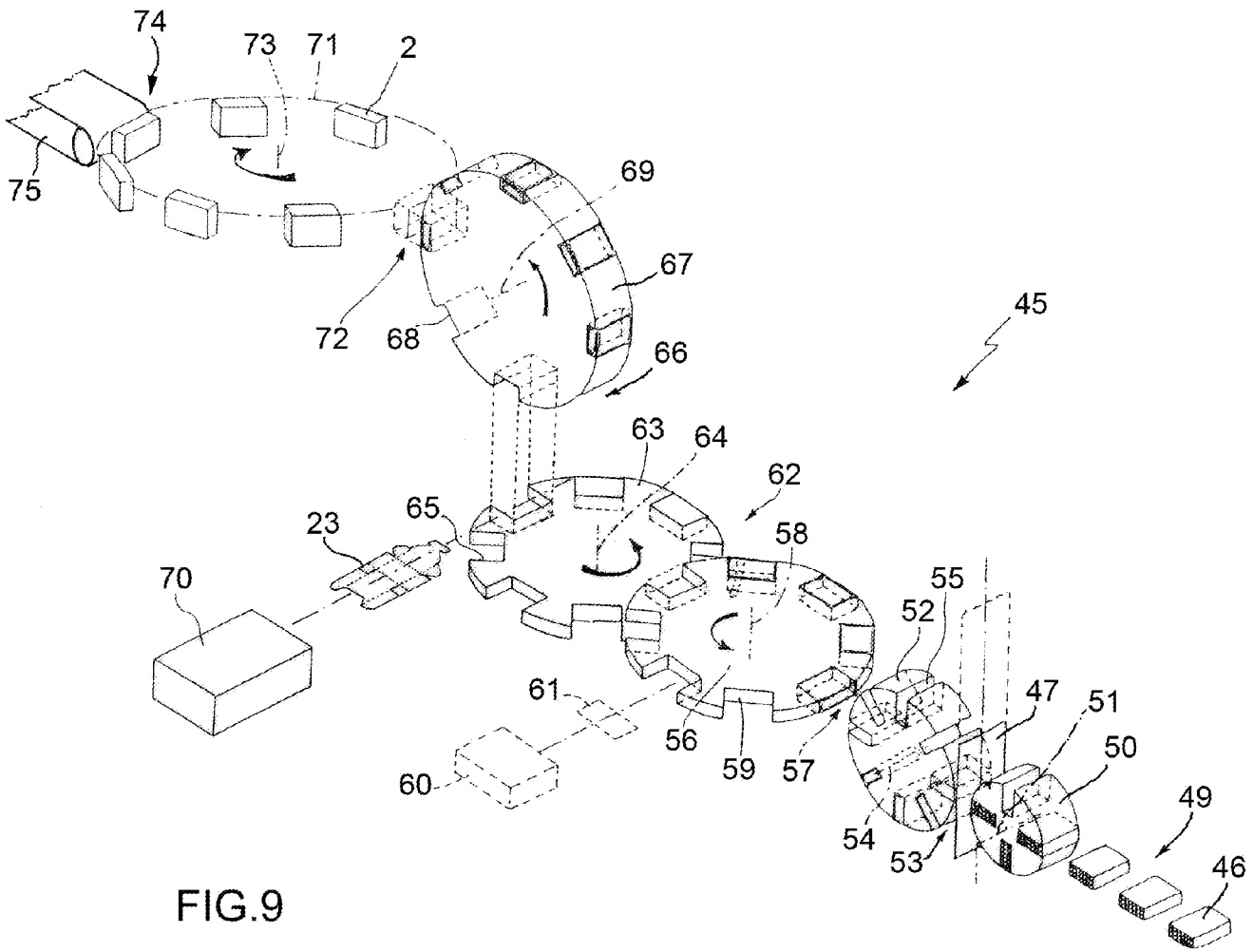
FIG. 9 shows a schematic view in perspective, with parts removed for clarity, of a first packing unit of the FIG. 8 packing machine.

As shown in FIG. 9, packing machine 44 comprises a packing unit 45, on which inner packages 3 are produced by folding sheets 47 of inner packing material successively about respective groups 46 of cigarettes, and outer containers 2 are formed by folding blanks 23 successively about respective inner packages 3; and a packing unit 48, on which packets 1 of cigarettes are completed by forming respective slides 14 about outer containers 2, i.e. by folding respective blanks 31 about outer containers 2.

Packing unit 45 of packing machine 44 comprises a known line 49 (shown schematically) for forming groups 46 of cigarettes; and a vertical transfer wheel 50, which rotates in steps about a horizontal axis of rotation 51 to receive groups 46 of cigarettes successively, and transfer groups 46 of cigarettes to a vertical packing wheel 52 at a transfer station 53.

Packing wheel 52 rotates in steps about a horizontal axis of rotation 54 parallel to axis of rotation 51, and has a number of peripheral pockets 55, each of which receives a group 46 of cigarettes together with a respective sheet 47 of foil inner packing material fed vertically to transfer station 53, between transfer wheel 50 and packing wheel 52. Next, packing wheel 52 folds each sheet 47 of packing material about a respective group 46 of cigarettes to form an inner package 3, which is then transferred to a horizontal packing wheel 56 at a transfer station 57.

Horizontal packing wheel 56 rotates in steps about a vertical axis of rotation 58 crosswise to axis of rotation 54, and has a number of peripheral pockets 59, each receiving an inner package 3 from packing wheel 52. In an alternative embodiment shown by the dash line, each pocket 59 on packing wheel 56 may also be supplied by a feed unit 60 with a coupon 61 before receiving inner package 3. At a transfer station 62, packing wheel 56 transfers each inner package 3 (possibly together with a respective coupon 61) to a horizontal packing wheel 63.

Horizontal packing wheel 63 rotates in steps about a vertical axis of rotation 64 parallel to axis of rotation 58, and has a number of peripheral pockets 65, each receiving an inner package 3 (possibly together with a respective coupon 61) from packing wheel 56.

On the periphery of both packing wheel 56 and 63, each rectangular parallelepiped-shaped inner package 3 is positioned flat, i.e. with a minor lateral wall facing outwards, and with its longitudinal axis (the axis parallel to the axes of the cigarettes) crosswise to axis of rotation 58, 64 and tangent to the periphery of packing wheel 56, 63. Packing wheels 63 and 56 overlap at transfer station 62, so inner packages 3 are transferred vertically from packing wheel 56 to packing wheel 63 in a direction parallel to axes of rotation 58 and 64. Transfer station 62 preferably comprises a bottom pusher and a top counter-pusher (not shown), which "grip" each inner package 3 to transfer it from a pocket 59 on packing wheel 56 to a pocket 65 on packing wheel 63.

At a transfer station 66, packing wheel 63 transfers each inner package 3 (possibly together with a respective coupon 61) to a vertical packing wheel 67, which overlaps packing wheel 63 at transfer station 66, so each inner package 3 (possibly together with a respective coupon 61) is transferred vertically from packing wheel 63 to packing wheel 67 in a direction parallel to axis of rotation 64. Transfer station 66 preferably comprises a bottom pusher and a top counter-pusher (not shown), which "grip" each inner package 3 (possibly together with a respective coupon 61) to transfer it from a pocket 65 on packing wheel 63 to a pocket 68 on packing wheel 67.

Vertical packing wheel 67 is an output wheel of packing machine 44, rotates in steps about a horizontal axis of rotation 69 parallel to axis of rotation 54, and has peripheral pockets 68, each of which receives an inner package 3 (possibly together with a respective coupon 61) from packing wheel 63, and a blank 23 fed to transfer station 66 by a feed unit 70. Packing wheel 67 has fixed and movable folders for folding each blank 23 about an inner package 3 (and possibly over a respective coupon 61) to form an outer container 2. Feed unit 70 preferably comprises a gumming device (not shown) which gums each blank 23 before it is fed to transfer station 66.

Outer containers 2 are fed successively from packing wheel 67 to a horizontal transfer wheel 71 at a transfer station 72. More specifically, on reaching transfer station 72, each outer container 2 is positioned on-edge on the periphery of packing wheel 67, i.e. with a major lateral wall facing outwards, and with its longitudinal axis (the axis parallel to the cigarettes) parallel to axis of rotation 69 of packing wheel 67. Horizontal transfer wheel 71 rotates in steps about a vertical axis of rotation 73 crosswise to axis of rotation 69 of packing wheel 67, receives outer containers 2 successively from packing wheel 67 at transfer station 72, and transfers outer containers 2 to a drying conveyor 75 (shown schematically in FIG. 8) at a transfer station 74. Drying conveyor 75 constitutes an output of packing unit 45, and feeds outer containers 2 to the next packing unit 48, where packets 1 of cigarettes are completed by forming respective slides 14, i.e. folding respective blanks 31, about outer containers 2.

Figure 10:
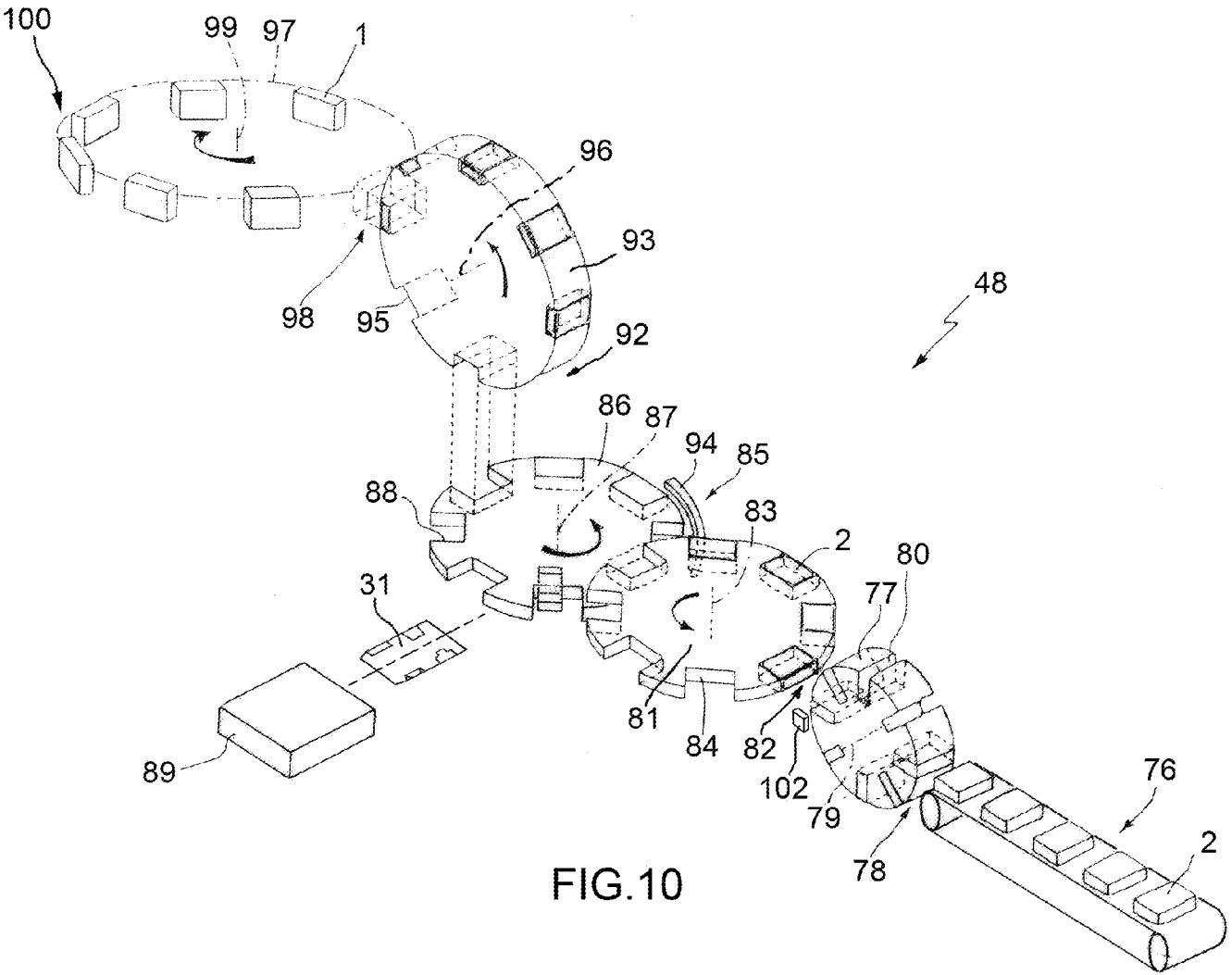
FIG. 10 shows a schematic view in perspective, with parts removed for clarity, of a second packing unit of the FIG. 8 packing machine.

As shown in FIG. 10, packing unit 48 comprises an input conveyor 76, which receives outer containers 2 from drying conveyor 75 of the preceding packing unit 45, and feeds outer containers 2 to a vertical transfer wheel 77 at a transfer station 78. Alternatively, drying conveyor 75 may constitute input conveyor 76.

Transfer wheel 77 rotates in steps about a horizontal axis of rotation 79 parallel to axis of rotation 69, and has a number of peripheral pockets 80, each of which receives an outer container 2 from input conveyor 76, and transfers output container 2 to a horizontal transfer wheel 81 at a transfer station 82.

Horizontal transfer wheel 81 rotates in steps about a vertical axis of rotation 83 crosswise to axis of rotation 79, has a number of peripheral pockets 84, each for receiving an outer container 2 from transfer wheel 77, and transfers each outer container 2 to a horizontal packing wheel 86 at a transfer station 85.

Horizontal packing wheel 86 rotates in steps about a vertical axis of rotation 87 parallel to axis of rotation 83, and has a number of peripheral pockets 88, each for receiving an outer container 2 from transfer wheel 81.

On the periphery of both transfer wheel 81 and packing wheel 86, each rectangular parallelepiped-shaped outer container 2 is positioned flat, i.e. with a minor lateral wall facing outwards, and with its longitudinal axis (the axis parallel to the axes of the cigarettes) crosswise to axes of rotation 83 and 87 and tangent to the periphery of transfer wheel 81 and packing wheel 86. Packing wheel 86 and transfer wheel 81 overlap at transfer station 85, so outer containers 2 are transferred vertically from transfer wheel 81 to packing wheel 86 in a direction parallel to axes of rotation 83 and 87. Transfer station 85 preferably comprises a bottom pusher and a top counter-pusher (not shown), which "grip" each outer container 2 to transfer it from a pocket 84 on transfer wheel 81 to a pocket 88 on packing wheel 86.

A feed unit 89 inserts each blank 31 (forming slide 14) into a pocket 88 on packing wheel 86, so as to fold blank 31 into a U inside pocket 88. In a preferred embodiment, before being inserted into a pocket 88 on packing wheel 86, blank 31 is gummed and folded into a substantially parallelepiped shape.

Figure 11:
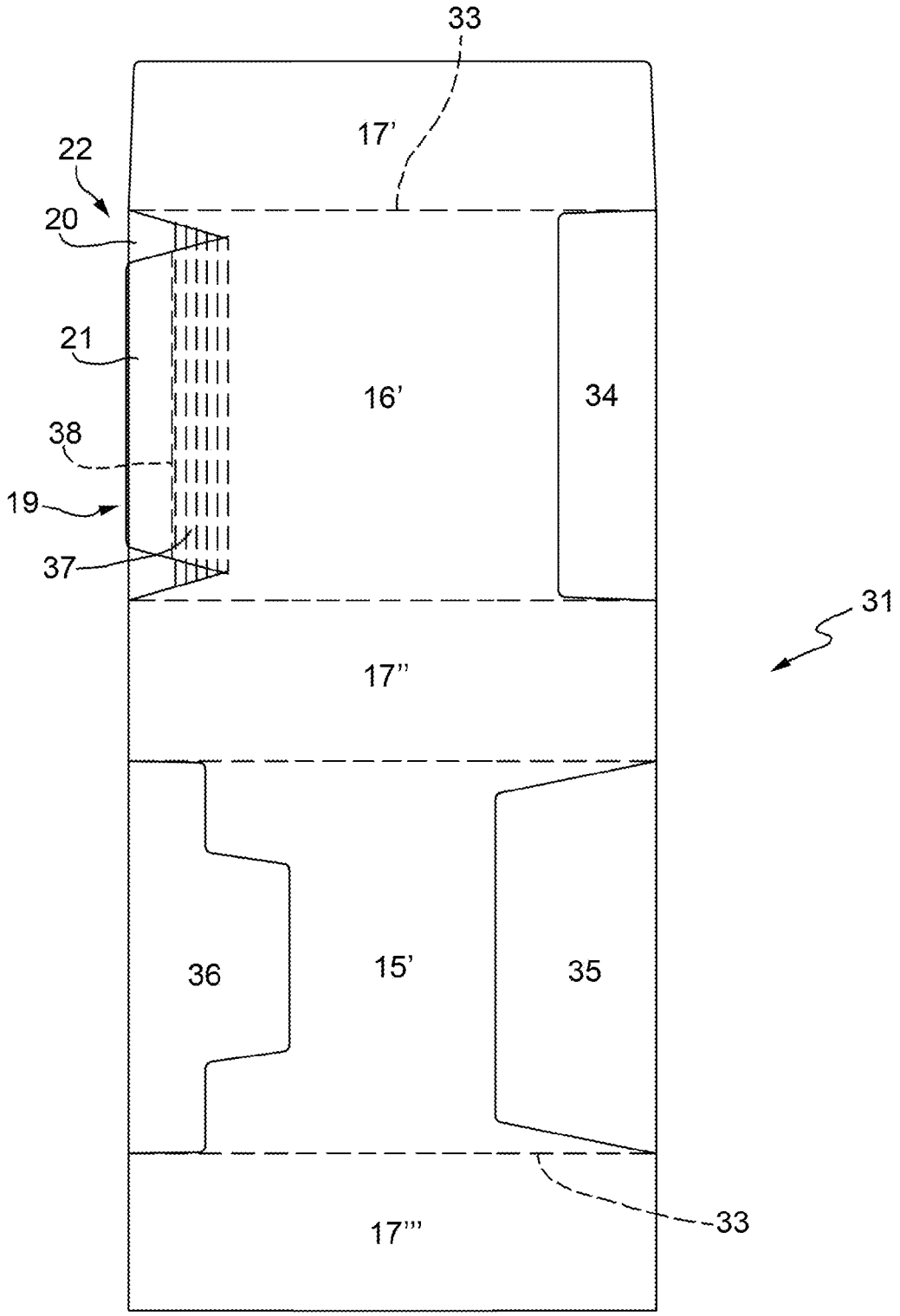
FIG. 11 shows the FIG. 6 blank partly folded and ready for supply to the second packing unit in FIG. 10.

With reference to FIG. 6 (blank 31 spread out flat) and FIG. 11 (blank 31 folded as fed by feed unit 89 into pocket 88 of packing wheel 86), tabs 35 and 36 are folded 180° about the two fold lines 32 onto panel 15'; tab 34 and transmission member 19 are folded 180° about the two fold lines 32 onto panel 16'; tabs 35 and 36 are glued to panel 15'; and tab 34 and transmission member 19 are glued to panel 16'. Transmission member 19 is not only folded into a U (i.e.) 180° about the respective fold line 32 onto panel 16', but is also folded 180° in half about a transverse crease line 37.

In the embodiment shown in the drawings, blanks 31 are gummed and folded beforehand as described upstream from packing machine 44, i.e. feed unit 89 receives blanks 31 already gummed and folded. In a different embodiment not shown, feed unit 89 receives blanks 31 flat, and gums and folds them as described before feeding them to packing wheel 86.

Blanks 31 being gummed and folded as described upstream from packing machine 44, i.e. feed unit 89 receiving blanks 31 already gummed and folded, transmission member 19 folded into a U about respective fold line 32 may spring open and become tangled in the fixed members of feed unit 89 or packing wheel 86, thus jamming (and so stopping) packing unit 48. This can be prevented using a slightly modified blank 31 as shown in FIG. 7, and which differs from the FIGS. 6 and 11 blank 31 by transmission member 19 comprising a central (preferably circular) fastening portion 40, which is glued to panel 16' of blank 31 and separated from the rest of transmission member 19 by an endless tear line 41 which is torn when unsealing lid 5.

The central fastening portion 40 serves to keep transmission member 19 folded down onto panel 16' of blank 31. In other words, to form packet 1 of cigarettes, transmission member 19 is preferably folded onto panel 16' of blank 31 beforehand (i.e. upstream from packing machine 44). But, without the aid of central fastening portion 40 glued to panel 16', transmission member 19 would not stay folded down onto panel 16' of blank 31 when handling (storing, carrying, feeding, folding) blank 31.

Figure 12:
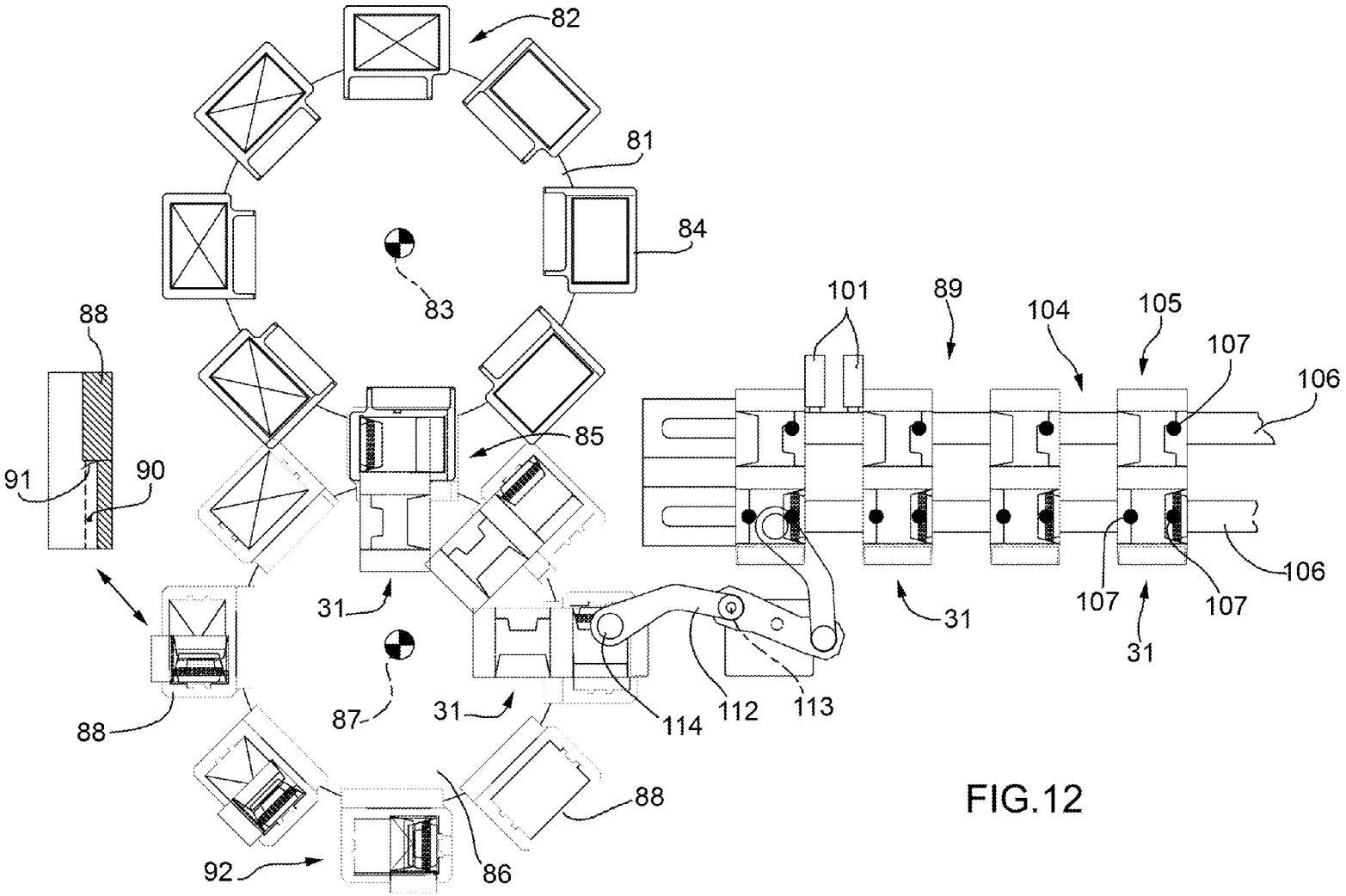
FIG. 12 shows a schematic plan view, with parts removed for clarity, of a slide feed unit and a packing wheel of the second packing unit in FIG. 10.

As shown in FIG. 12, each blank 31, gummed and folded as described, is inserted by feed unit 89 into a pocket 88 on packing wheel 86, so as to fold into a U inside pocket 88. More specifically, each blank 31 is inserted downwards into pocket 88 on packing wheel 86, so that panel 16' is positioned horizontally inside pocket 88, panel 17' is positioned vertically (i.e. folded 90° with respect to panel 16' about a longitudinal fold line 33) inside pocket 88 and contacting a vertical outer wall of pocket 88, panel 17" is positioned vertically (i.e. folded 90° with respect to panel 16' about a longitudinal fold line 33) inside pocket 88 and contacting a vertical inner wall of pocket 88, and panels 15' and 17''' are positioned horizontally (i.e. folded 90° with respect to panel 17" about a longitudinal fold line 33) outside pocket 88 and towards the centre of packing wheel 86.

Each pocket 88 preferably has a seat 90 for housing a blank 31, in particular panel 16' of blank 31; and an elastic retainer 91 located inside seat 90, and which pushes blank 31, in particular panel 16' of blank 31, against a wall of seat 90 to push blank 31 into and keep it in a desired predetermined position. In other words, since seat 90 must necessarily be larger than panel 16' to insert panel 16' of blank 31 inside seat 90, elastic retainer 91 serves to prevent panel 16' from being "tossed" out of position inside seat 90, by deforming to permit insertion of panel 16' of blank 31 inside seat 90, and then pushing panel 16' of blank 31 against a wall of seat 90.

At transfer station 85, each outer container 2 is fed vertically downwards from a pocket 84 on transfer wheel 81 to a pocket 88 containing a U-folded blank 31 on packing wheel 86, so that panels 17', 17" and 16' of blank 31 surround the sides and bottom of outer container 2.

At a transfer station 92, packing wheel 86 transfers each outer container 2, together with blank 31, to a vertical transfer wheel 93. Between transfer station 85 and transfer station 92, packing wheel 86 has a folding device 94 (normally fixed folding screws) which folds panel 15' of each blank 31 through 180° about a longitudinal fold line 33 onto the front wall 9 of outer container 2. Finally, as outer container 2, together with blank 31, is transferred from packing wheel 86 to transfer wheel 93 at transfer station 92, panel 17''' of blank 31 is folded 90° about a longitudinal fold line 33 onto the already folded panel 17', to complete folding blank 31 about outer container 2 and so complete slide 14.

Transfer wheel 93 overlaps packing wheel 86 at transfer station 92, so each outer container 2, together with a blank 31, is transferred vertically from packing wheel 86 to transfer wheel 93 in a direction parallel to axis of rotation 87. Transfer station 92 preferably comprises a bottom pusher and a top counter-pusher (not shown), which "grip" each outer container 2, together with blank 31, to transfer outer container 2 from a pocket 88 on packing wheel 86 to a pocket 95 on transfer wheel 93.

Vertical transfer wheel 93 is an output wheel of packing unit 48 of packing machine 44, rotates in steps about a horizontal axis of rotation 96 parallel to axis of rotation 79, and has peripheral pockets 95, each fed by packing wheel 86 with an outer container 2 fitted with slide 14 (i.e. a complete packet 1 of cigarettes). Packets 1 of cigarettes are fed successively from transfer wheel 93 to a further horizontal transfer wheel 97 at a transfer station 98. More specifically, on reaching transfer station 98, each packet 1 of cigarettes is positioned on-edge on the periphery of transfer wheel 93, i.e. with a major lateral wall facing outwards, and with its longitudinal axis (the axis parallel to the cigarettes) parallel to axis of rotation 96 of transfer wheel 93. Horizontal transfer wheel 97 rotates in steps about a vertical axis of rotation 99 crosswise to axis of rotation 96 of transfer wheel 93, receives packets 1 of cigarettes successively from transfer wheel 93 at transfer station 98, and transfers packets 1 of cigarettes to a drying conveyor (not shown) at a transfer station 100. The drying conveyor constitutes an output of packing unit 48 (i.e. of packing machine 44), and feeds packets 1 of cigarettes to a follow-up cellophaning machine (not shown), which applies an overwrapping of transparent plastic material about each packet 1 of cigarettes.

Once blank 31 is folded about outer container 2, panels 17' and 17''' must be glued to each other to stabilize the shape of slide 14. As shown in FIG. 12, packing unit 48 of packing machine 44 therefore comprises a gumming device 101, in turn comprising a number of known gum spray devices to gum an inner surface of panel 17''' of each blank 31. Gumming device 101 may be fitted to feed unit 89, or to packing wheel 86, upstream from transfer station 85, or to packing wheel 86, upstream from transfer station 92 (i.e. downstream from transfer station 85).

In one possible embodiment, besides gumming an inner surface of panel 17''' of each blank 31, gumming device 101 may also gum end 21 of each blank 31, which is necessary to connect end 21 firmly to the outer surface of rear wall 10 of outer container 2. Alternatively, packing unit 48 of packing machine 44 may comprise a gumming device 102, in turn comprising a number of known gum spray devices to gum rear wall 10 of each outer container 2, and which is located at transfer station 82, as shown in FIG. 10. It is important to note that, compared with gumming device 101, gumming device 102 is simpler geometrically, and also provides for easier handling of blanks 31.

Figure 13:
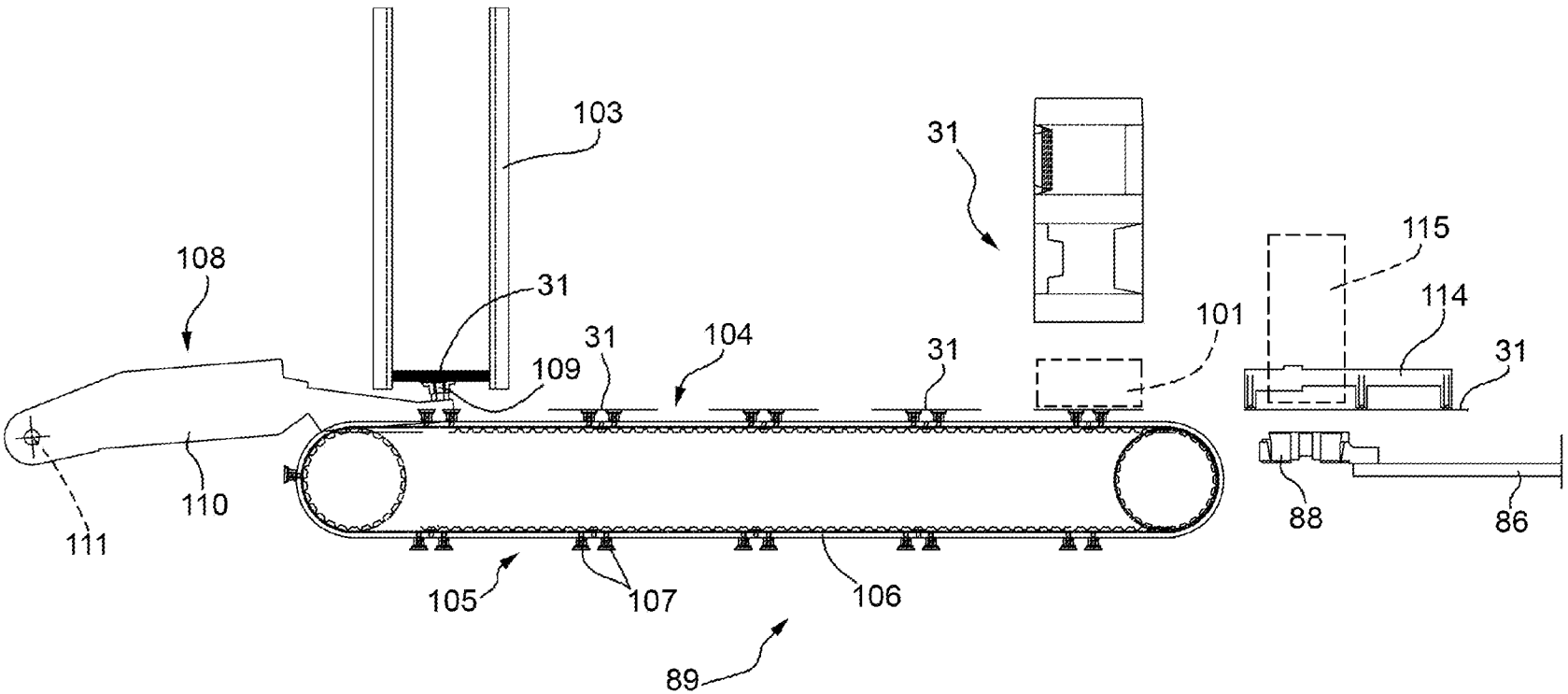
FIG. 13 shows a schematic side view, with parts removed for clarity, of the slide feed unit in FIG. 12.

As shown in FIGS. 12 and 13, feed unit 89 comprises a vertical hopper 103 housing a stack of prefolded blanks 31 and having a bottom outlet located over a horizontal conveyor 104, which advances in steps and has a number of suction heads 105. More specifically, conveyor 104 comprises two endless belts 106 looped about two peripheral end pulleys, and each of which supports a number of suction cups 107 (possibly arranged in pairs). Each suction head 105 comprises at least a first suction cup 107 of one belt 106, and at least a second suction cup 107 of the other belt 106, aligned with the first suction cup 107.

A pickup device 108 withdraws blanks 31 successively from the bottom outlet of hopper 103, and feeds them to suction heads 105 on conveyor 104. More specifically, pickup device 108 comprises a suction head 109 fitted to an arm 110 which rotates about a horizontal axis of rotation 111, and located between the two belts 106 of conveyor 104 to move cyclically between a top pickup position, in which suction head 109 engages a blank 31 at the bottom outlet of hopper 103, and a bottom release position, in which suction head 109 places a blank 31 on a suction head 105 of conveyor 104.

Feed unit 89 also comprises a transfer arm 112, which rotates back and forth about a vertical axis of rotation 113 to move a suction head 114 cyclically between a pickup position, in which suction head 114 is located over the output end of conveyor 104, and a release position, in which suction head 114 is located over a pocket 88 on packing wheel 86.

Finally, feed unit 89 comprises an insertion pusher 115 located over packing wheel 86 and aligned with a pocket 88, and which is moved vertically up and down to push the blank 31 carried by suction head 114 of transfer arm 112 into pocket 88 on packing wheel 86. This type of insertion folds blank 31 into a U inside pocket 88 on packing wheel 86 as described above.

As stated, in an alternative embodiment shown by the dash line in FIG. 9, each pocket 59 on packing wheel 56 may also be fed by a feed unit 60 with a coupon 61 before receiving inner package 3. In which case, in addition to coupon 61, each pocket 59 on packing wheel 56 may also be fed with a holding strip, which is subsequently folded into a U about inner package 3 and over coupon 61, is folded about a bottom portion of inner package 3 so as to be invisible from the open top end 4 of outer container 2, and serves to hold coupon 61 in position on inner package 3 as inner package 3 travels from transfer station 57 to transfer station 66.

Packing machine 44 as described provides for producing a rigid, hinged-lid packet 1 of cigarettes comprising a tubular slide 14 enclosing and sliding axially with respect to outer container 2, and can be obtained, with only a few low-cost alterations, using two existing packing machines (typically, G.D. packing machines X2 or X3) arranged in series to form packing units 45 and 48. Moreover, packing machine 44 described allows suitable access to all its component parts.

The invention claimed is:

1. A method of producing a rigid, hinged-lid packet, the method comprising:

folding a first blank (23) about a group (46) of cigarettes to form an container (2) with a hinged lid (5);

folding a second blank (31) about the container (2) to form an outer tubular slide (14) surrounding the container (2) to slide axially with respect to the container (2); the outer tubular slide (14) having a transmission member (19), in turn having a first end (21) integral with the lid (5), a second end (20) opposite the first end (21) and integral with the slide (14), and a deformable intermediate portion (22) having a U-shaped fold between the container (2) and the slide (14);

folding the transmission member (19) into a U and 180° onto a panel (16') of the second blank (31) before folding the second blank (31) about the container (2);

forming on the transmission member (19) a central fastening portion (40) separated from the rest of the transmission member (19) by an endless tear line (41) which is torn when unsealing the lid (5); and gluing the central fastening portion (40) of the transmission member (19) to the panel (16') of the second blank (31) before folding the second blank (31) about the container (2).

2. A method as claimed in claim 1, and comprising the further step of folding tabs (34, 35, 36) of the second blank (31) 180° onto respective panels (15', 16') of the second blank (31) before folding the second blank (31) about the container (2).

3. A method as claimed in claim 2, and comprising the further step of gumming the tabs (34, 35, 36) of the second blank (31)to the respective panels (15', 16') of the second blank (31) before folding the second blank (31) about the container (2).

4. A method of producing a rigid, hinged-lid packet, the method comprising:

folding a first blank (23) about a group (46) of cigarettes to form an container (2) with a hinged lid (5); and folding a second blank (31) about the container (2) to form an outer tubular slide (14) surrounding the container (2) to slide axially with respect to the container (2); the outer tubular slide (14) having a transmission member (19), in turn having a first end (21) integral with the lid (5), a second end (20) opposite the first end (21) and integral with the slide (14), and a deformable intermediate portion (22) having a U-shaped fold between the container (2) and the slide (14), wherein the second blank (31) has two transverse fold lines (32), and a number of longitudinal fold lines (33) defining, between the two transverse fold lines (32), a first panel (17') forming a portion of a first lateral wall (17) of the slide (14); a second panel (16') forming a rear wall (16) of the slide (14); a third panel (17") forming a second lateral wall (17) of the slide (14); a fourth panel (15') forming a front wall (15) of the slide (14); and a fifth panel (17'") forming another portion of the first lateral wall (17) of the slide (14), wherein the second panel (16') of the second blank (31) supports the transmission member (19), which is separated from the second panel (16') by a transverse fold line (32), and wherein the fourth panel (15') has at least two second tabs (35, 36) located at opposite ends of the fourth panel (15') and separated from the fourth panel (15') by the two transverse fold lines (32); and wherein the tabs (34, 35, 36) of the second blank (31) are folded 180° onto respective panels (15', 16') of the second blank (31) before folding the second blank (31) about the container (2).

5. A method as claimed in claim 4, and comprising the further step of gumming the tabs (34, 35, 36) of the second blank (31) to the respective panels (15', 16') of the second blank (31) before folding the second blank (31) about the container (2).

6. A method as claimed in claim 4, wherein the second panel (16') of the second blank (31) has a first tab (34) located at the opposite end to the transmission member (19) and separated from the second panel (16') by a transverse fold line (32).

7. A cigarette packing machine for producing a rigid packet (1) with a hinged lid (5); the packing machine (44) comprising:

a first packing unit (45) which folds a first blank (23) about a group (46) of cigarettes to form an container (2) with a hinged lid (5);

a second packing unit (48) which folds a second blank (31) about the container (2) to form an outer tubular slide (14) surrounding the container (2) to slide axially with respect to the container (2), the outer tubular slide (14) having a transmission member (19), in turn having a first end (21) integral with the lid (5), a second end (20) opposite the first end (21) and integral with the slide (14), and a deformable intermediate portion (22) having a U-shaped fold between the container (2) and the slide (14);

at least one first pocket (88);

a first feed unit (89) which feeds the second blank (31) to the first pocket (88);

a first transfer station (85) which transfers the container (2) to the first pocket (88);

a folding device (94) which folds the second blank (31) about the container (2); and a second transfer station (92) which transfers the container (2), together with the second blank (31), from the first pocket (88), wherein the second blank (31) supports the transmission member (19) and the feed unit (89) folds into a U and folds 180° the transmission member (19) onto a respective panel (16') of the second blank (31), and wherein the second blank (31) comprises tabs (34, 35, 36, 39) and the feed unit (89) folds 180° the tabs (34, 35, 36, 39) onto respective panels (15', 16', 17') of the second blank (31).

8. A packing machine as claimed in claim 7, wherein the second packing unit (48) comprises a first packing wheel (86) having the first pocket (88).

9. A packing machine as claimed in claim 8, and comprising a second gumming device (102), which gums a rear wall (10) of the container (2).

10. A packing machine as claimed in claim 9, wherein the second gumming device (102) is located at the first transfer station (82).

11. A packing machine as claimed in claim 8, wherein the second packing unit (48) comprises:

an input conveyor (76) which receives the container (2) from the first packing unit (45);

a vertical first transfer wheel (77) which receives the container (2) from the input conveyor (76) at a third transfer station (78);

a horizontal second transfer wheel (81) which receives the container (2) from the first transfer wheel (77) at a fourth transfer station (82), and transfers the container (2) to the first pocket (88) at the first transfer station (85); and a vertical third transfer wheel (93) which receives the container (2), together with the folded second blank (31) defining the slide (14), from a first packing wheel (86) having the first pocket (88) at the second transfer station (92).

12. A packing machine as claimed in claim 7, wherein the first feed unit (89) is located upstream from the first transfer station (85), and inserts the second blank (31), folded into a U, into the first pocket (88).

13. A packing machine as claimed in claim 12, wherein the first pocket (88) has a seat (90) for housing the second blank (31); and an elastic retainer (91) located inside the seat (90) and which pushes the second blank (31) against a wall of the seat (90).

14. A packing machine as claimed in claim 12, wherein the second blank (31) has two transverse fold lines (32), and a number of longitudinal fold lines (33) defining, between the two transverse fold lines (32), a first panel (17') forming a portion of a first lateral wall (17) of the slide (14); a second panel (16') forming a rear wall (16) of the slide (14); a third panel (17") forming a second lateral wall (17) of the slide (14); a fourth panel (15') forming a front wall (15) of the slide (14); and a fifth panel (17''') forming another portion of the first lateral wall (17) of the slide (14);

the first feed unit (89) inserting the second blank (31) downwards into the first pocket (88), so the second panel (16') is positioned horizontally inside the first pocket (88), the first panel (17') and third panel (17") are positioned folded squarely with respect to the second panel (16'), and the fourth panel (15') and fifth panel (17''') are positioned folded squarely with respect to the third panel (17") and outside the first pocket (88).

15. A packing machine as claimed in claim 14, wherein the folding device (94) between the first transfer station (85) and second transfer station (92) folds the fourth panel (15') 180° about a longitudinal fold line (33) onto a front wall (9) of the container (2); and transfer of the container (2), together with the second blank (31), from the first pocket (88) at the second transfer station (92) folds the fifth panel (17''') 90° about a longitudinal fold line (33) onto the previously folded first panel (17').

16. A packing machine as claimed in claim 14, wherein:

the second panel (16') of the second blank (31) supports the transmission member (19), which is separated from the second panel (16') by a transverse fold line (32);

the second panel (16') of the second blank (31) has a first tab (34) located at the opposite end to the transmission member (19) and separated from the second panel (16') by a transverse fold line (32);

the fourth panel (15') has two second tabs (35, 36) located at opposite ends of the fourth panel (15') and separated from the fourth panel (15') by the two transverse fold lines (32);

the third panel (17") has two third tabs (39) located at opposite ends of the third panel (17") and separated from the third panel (17") by the two transverse fold lines (32); and the second blank (31) is fed to the first pocket (88) with the second tabs (35, 36) folded 180° onto the fourth panel (15'), with the transmission member (19) folded into a U and folded 180° onto the second panel (16'), and with the first tab (34) folded 180° onto the second panel (16').

17. A packing machine as claimed in claim 14, and comprising a first gumming device (101), which gums an inner surface of the fifth panel (17''') of the second blank (31) and is connected to a first packing wheel (86) having the first pocket (88).

18. A packing machine as claimed in claim 14, and comprising a first gumming device (101), which gums an inner surface of the fifth panel (17''') of the second blank (31) and is connected to the first feed unit (89).

19. A packing machine as claimed in claim 8, wherein the first feed unit (89) comprises:

a hopper (103) housing a stack of second blanks (31);

a horizontal conveyor (104) located beneath a bottom outlet of the hopper (103) and having a number of first suction heads (105);

a pickup device (108) which withdraws the second blanks (31) successively from the bottom outlet of the hopper (103) and feeds the second blanks (31) to the first suction heads (105) of the conveyor (104);

a transfer arm (112) which rotates back and forth about a vertical axis of rotation (113) to move a second suction head (114) cyclically between a pickup position, in which the second suction head (114) is located over an output end of the conveyor (104), and a release position, in which the second suction head (114) is located over the first pocket (88); and an insertion pusher (115) located over a first packing wheel (86) having the first pocket (88) and aligned with the first pocket (88), and which is moved vertically up and down to push a second blank (31) carried by the second suction head (114) of the transfer arm (112) into the first pocket (88) of the first packing wheel (86); this type of insertion folding the second blank (31) into a U inside the first pocket (88) as described previously.

20. A packing machine as claimed in claim 19, wherein the pickup device (108) comprises a third suction head (109) fitted to an arm (110) which rotates about a horizontal axis of rotation (111), and located between two belts (106) of the conveyor (104) to move cyclically between a top pickup position, in which the third suction head (109) engages a second blank (31) at the bottom outlet of the hopper (103), and a bottom release position, in which the third suction head (109) places a second blank (31) on a first suction head (105) of the conveyor (104).

21. A cigarette packing machine for producing a rigid packet (1) with a hinged lid (5); the packing machine (44) comprising:

a first packing unit (45) which folds a first blank (23) about a group (46) of cigarettes to form an container (2); and a second packing unit (48) which folds a second blank (31) about the container (2) to form an outer tubular slide (14) surrounding the container (2) to slide axially with respect to the container (2);

wherein the second packing unit (48) comprises:

a first packing wheel (86) having at least one first pocket (88);

a first feed unit (89) which feeds the second blank (31) to the first pocket (88) of the first packing wheel (86);

a first transfer station (85) which transfers the container (2) to the first pocket (88) of the first packing wheel (86);

a folding device (94) which folds the second blank (31) about the container (2); and a second transfer station (92) which transfers the container (2), together with the second blank (31), from the first pocket (88) of the first packing wheel (86); and wherein the first feed unit (89) receives the second blank (31) flat and gums and folds the second blank (31) before feeding the second blank (31) to the first pocket (88) of the first packing wheel (86).

22. A cigarette packing machine for producing a rigid packet (1) with a hinged lid (5); the packing machine (44) comprising:

a first packing unit (45) which folds a first blank (23) about a group (46) of cigarettes to form an container (2) with a hinged lid (5); and a second packing unit (48) which folds a second blank (31) about the container (2) to form an outer tubular slide (14) surrounding the container (2) to slide axially with respect to the container (2);

wherein the outer tubular slide (14) has a transmission member (19), in turn having a first end (21) integral with the lid (5), a second end (20) opposite the first end (21) and integral with the slide (14), and a deformable intermediate portion (22) having a U-shaped fold between the container (2) and the slide (14);

wherein the second packing unit (48) comprises:

a first packing wheel (86);

at least one first pocket (88) provided in the first packing wheel (86);

a first feed unit (89) which feeds the second blank (31) to the first pocket (88) of the first packing wheel (86);

a first transfer station (85) which transfers the container (2) to the first pocket (88);

a folding device (94) which folds the second blank (31) about the container (2); and a second transfer station (92) which transfers the container (2), together with the second blank (31), from the first pocket (88); and wherein the second blank (31) is gummed and folded into a substantially parallelepiped shape before being inserted into the first pocket (88) of the first packing wheel (86).

* * * * *